United States Patent [19]

Siegert et al.

[11] Patent Number: 4,508,202

[45] Date of Patent: Apr. 2, 1985

[54] FULL-STRAP ASSEMBLY FOR TOWING A WHEELED SUITCASE

[75] Inventors: Günter Siegert, Iserlohn; Ulf Rasch, Altena, both of Fed. Rep. of Germany

[73] Assignee: SUDHAUS Schloss- und Beschlagtechnik GmbH & Co., Iserlohn, Fed. Rep. of Germany

[21] Appl. No.: 491,971

[22] Filed: May 5, 1983

[30] Foreign Application Priority Data

Jan. 7, 1983 [DE] Fed. Rep. of Germany ... 8300286[U]

[51] Int. Cl.[3] ..... A45C 5/14; A45C 13/26

[52] U.S. Cl. ..... 190/115; 190/18 A; 16/115

[58] Field of Search ..... 190/18 A, 39, 115; 150/33, 110, 107, 108 (U.S. only); 16/115, 110 R; 280/37

[56] References Cited

U.S. PATENT DOCUMENTS

| | | | |
|---|---|---|---|
| 1,979,978 | 11/1934 | Martin | 190/115 |
| 2,009,192 | 7/1935 | Freysinger | 16/115 X |
| 3,128,853 | 4/1964 | Hoffman et al. | 150/33 X |
| 3,982,613 | 9/1976 | Wood | 190/18 A X |
| 3,995,802 | 12/1976 | Johnston | 190/115 X |

FOREIGN PATENT DOCUMENTS 8200290 5/1982 Fed. Rep. of Germany .

*Primary Examiner*—William Price
*Assistant Examiner*—Sue A. Weaver
*Attorney, Agent, or Firm*—Karl F. Ross; Herbert Dubno

[57] ABSTRACT

A strap for towing a wheeled suitcase, passing through a slit in an end wall of the suitcase, is retractable into a housing adjoining that wall from within and containing a coil spring whose free end is coupled with that strap, advantageously through a roller or other deflecting member around which the strap is looped inside the housing. The free outer end of the strap is secured to a handgrip by having holes traversed by pins on a backing plate integral with that handgrip, the front of this strap end being covered by a flap which may be an integral extension of the backing plate folded around the strap and clamped in position with a snap fit. The backing plate has two rearwardly projecting lips which enter the slit of the suitcase wall in a retracted position and are separated by a gap traversed by the strap, these lips passing between ribs of a shield plate that penetrate the slit and engage the housing.

19 Claims, 9 Drawing Figures

FULL-STRAP ASSEMBLY FOR TOWING A WHEELED SUITCASE

FIELD OF THE INVENTION

Our present invention relates to a pull-strap assembly used for towing a suitcase supported by a wheel base (usually comprising four rollers or wheels), a strap being attached to an upright end wall in the vicinity of an upper edge thereof.

BACKGROUND OF THE INVENTION

It is known to provide the aforementioned end wall with a horizontal slit traversed by a towing strap which has a handgrip secured to its outer extremity and has its inner extremity attached to a spring anchored to the interior of the suitcase for tending to draw the strap in. In these known devices the spring is of the spiral kind partly wound into a coil within the suitcase. This is somewhat inconvenient since the coil, for protection, must be enclosed in a housing taking up considerable space.

OBJECTS OF THE INVENTION

An important object of our present invention, therefore, is to provide a pull-strap assembly which includes a strap-biasing spring and a housing therefor occupying relatively little space in the interior of a suitcase.

A related object is to provide means in such an assembly for maximizing the extent of possible pull-out of the strap with a spring housing of given dimensions.

A further object of our invention is to provide means for safely guiding such a spring-loaded strap through a slit in a suitcase wall and, at the same time, unobtrusively accommodating its handgrip on the outer wall surface in a retracted position of the strap.

SUMMARY OF THE INVENTION

An assembly according to our invention comprises a housing which extends vertically along an inner surface to an end wall of a suitcase provided near its upper edge with a slit as discussed above, the housing enclosing a contractile coil spring which is anchored to a lower end thereof. A strap passing through the slit and through an adjoining opening of the housing is coupled inside the housing to a free end of the spring at a location between the lower housing end and the slit; an outer extremity of the strap is secured to a handgrip.

Advantageously, pursuant to a more particular feature of our invention, the free end of the spring is provided with deflecting means—preferably a roller—around which the strap is looped while having an inner extremity secured to an upper end of the housing. This arrangement substantially doubles the pull-out range of the strap whose limit is reached when the spring, occupying a small fraction of the height of the housing in its contracted state, is fully extended.

According to a further feature of our invention, advantageously but not necessarily used in conjunction with a tensionable coil spring of the type referred to, resides in the provision of a backing plate on the handgrip which is disposed behind the outer strap extremity and is provided with at least one forwardly projecting pin traversing a hole in that strap extremity, the latter being covered by a front flap which engages the backing plate to clamp the strap therebetween. We prefer to make the front flap an integral extension of the backing plate which is folded about the engaged strap extremity.

In accordance with yet another feature of our invention the backing plate is provided with a pair of rearwardly facing lips that are separated by a gap and are receivable in the slit of the end wall of the suitcase in a retracted position of the strap, these lips advantageously fitting between upper and lower ribs of a shield plate on that end wall which penetrate the slit and engage the spring housing through positively interengaging coupling means.

BRIEF DESCRIPTION OF THE DRAWING

The above and other features of our invention will now be described in detail with reference to the accompanying drawing in which.

SPECIFIC DESCRIPTION

Figure 3:
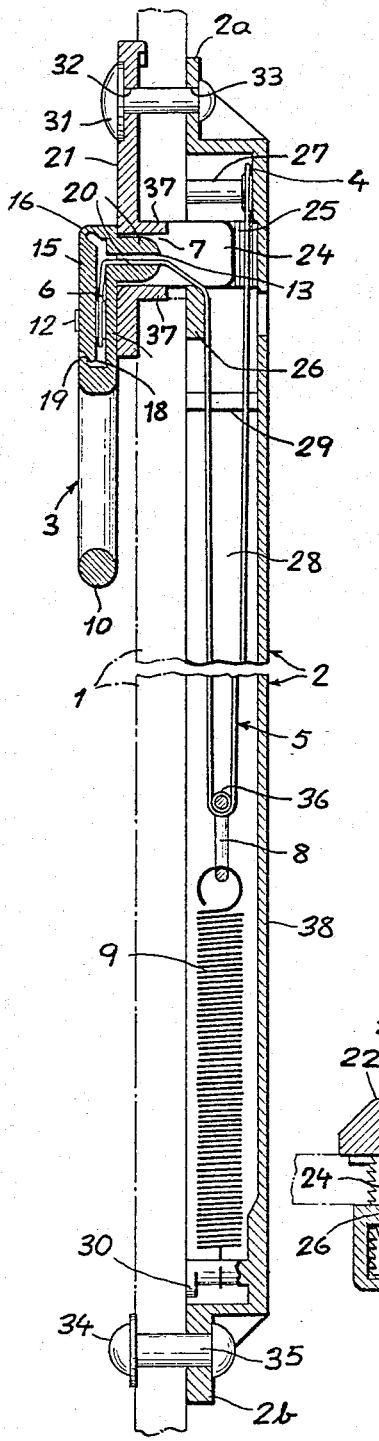
FIG. 3 is a sectional elevational view taken on the line III—III of FIG. 1.
Figure 2:
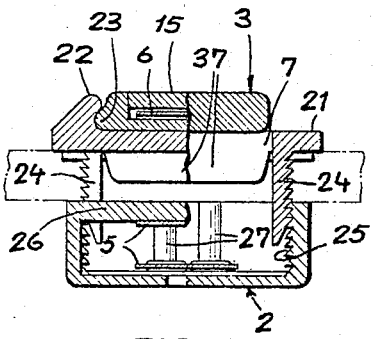
FIG. 2 is a cross-sectional view taken on the line II—II of FIG. 1.
Figure 1:
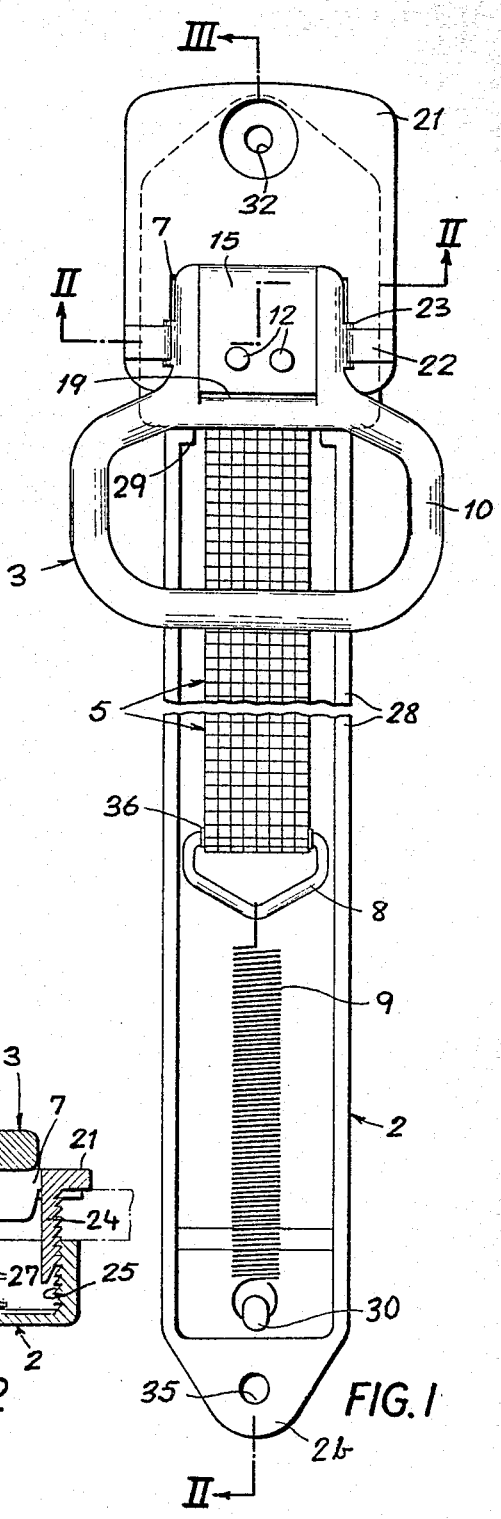
FIG. 1 is a front-elevational view of a pull-strap assembly according to our invention.
Figure 4:
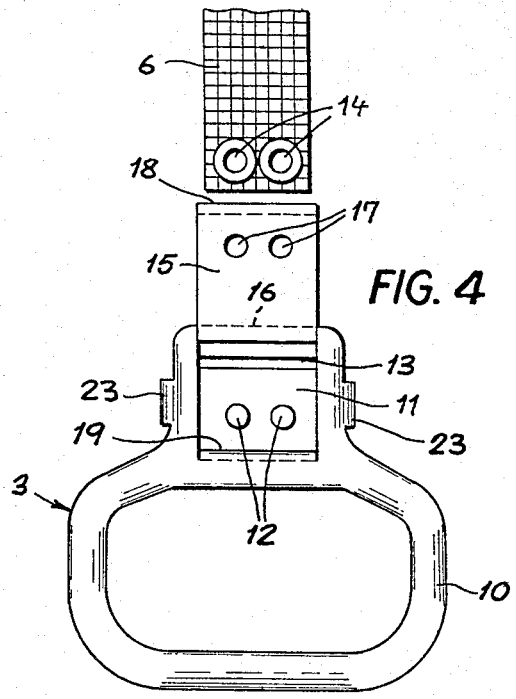
FIG. 4 is a front view of a handgrip and a strap, forming part of the assembly of FIGS. 1–3, shown in a disassembled position.
Figure 7:
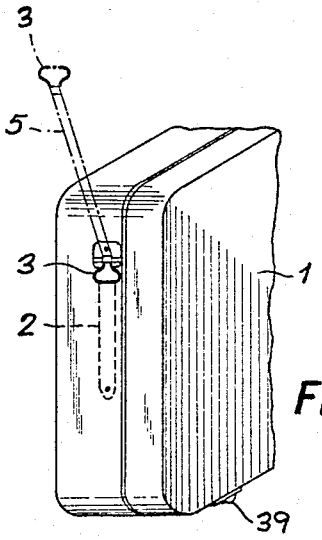
* and FIG. 7 is a fragmentary perspective view of a suitcase equipped with the assembly of FIGS. 1 and 3.

In FIGS. 1–3 we have illustrated an upright, elongate housing 2 of generally rectangular cross-section open at one of its major vertical sides at which it adjoins the inner surface of an end wall of a suitcase 1 rolling on four wheels 39 (only one shown in FIG. 7), the wall being indicated in phantom lines in FIG. 3. A strap 5 has an inner extremity 4 and an outer extremity 6 each provided with a pair of closely juxtaposed holes 14 as illustrated in FIG. 4 for extremity 6. The holes of extremity 4 are traversed by respective pins 27 that are secured to a substantially solid rear wall 38 of housing 2 near the upper end thereof and terminate at the end wall of suitcase 1 above a horizontal slit 7 formed in that wall. Strap 5 is looped within housing 2 about a roller 36 which is journaled on a triangular link 8 serving to couple the bight of the strap to the upper end of a contractile coil spring 9 whose lower end is fixedly anchored to housing 2 by a stud 30 disposed just above the housing bottom.

An upper housing flange 2*a* and a lower housing flange 2*b* have holes 33 and 35 traversed by respective rivets 31 and 34, the upper rivet 31 also passing through a hole 32 of a shield plate 21 which overlies the front surface of the suitcase wall and has upper and lower ribs 37 partly extending into slit 7. Plate 21 further has a pair of lateral lugs 24 which flank the ribs 37 and have sawteeth interlockingly engaging complementary sawteeth 25 on the inner surfaces of lateral walls 28 of housing 2 in order to hold plate 21 firmly in position.

Figure 5:
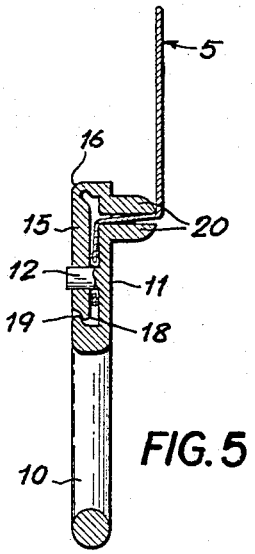
FIG. 5 is a sectional view, similar to part of FIG. 3, showing the elements of FIG. 4 in an assembled state.

Strap 5, passing outward between lugs 24 and ribs 27 of plate 21, has its extremity 6 firmly connected with a handgrip generally designated 3. The latter comprises a ring 10 integral with a backing plate 11 which in turn is formed with upper and lower lips 20 separated by a narrow gap 13 giving passage to strap 5. As best seen in FIGS. 4 and 5, a front flap 15 forms an integral extension of plate 11 with which it is connected by a transverse zone 16 of reduced width; two pins 12 projecting forward from backing plate 11 pass through the holes 14 of strap extremity 6 and also traverse a pair of holes 17 of flap 15 when the latter is bent about zone 16 from an initial position substantially coplanar with plate 11 (FIG. 4) to a clamping position (FIGS. 1–3 and 5) in which it bears upon this strap extremity. A ledge 18 at the free edge of flap 15 snaps behind an upstanding ledge 19 of plate 11 to hold the flap in this clamping position.

Since the two ends of strap 5 are of the same shape and have identically positioned perforations 14, either end could be initially attached to handgrip 3.

When the strap 5 is fully retracted by the tension spring 9, handgrip 3 occupies the position of FIGS. 1–3 in which the lips 20 of its backing plate 11 penetrate into the space bounded by ribs 37 and lugs 24 of shield plate 21. In this position a pair of lateral projections 22 on shield plate 21 elastically overhang respective wings 23 of handgrip 3 for yieldably retaining same next to the end wall of suitcase 1; see also FIG. 7 in which the retracted position of the handgrip is shown in full lines while the extended strap has been indicated in phantom lines.

As shown in FIG. 3, a web 26 extends horizontally across the open front of housing 2 at a location just below slit 7, thereby defining with a housing top an aperture communicating with that slit. Web 26 has a rounded upper edge smoothly guiding the strap 5 through that slit when the handgrip 3 is pulled or relaxed.

FIG. 1 further shows that the lateral housing walls 28 are provided with abutments 29 projecting toward each other to an extent sufficient to intercept the sides of link 8, thereby limiting the extraction of the strap from the housing and preventing the link 8 with its roller 36 from becoming jammed in the slit 7.

Figure 6B:
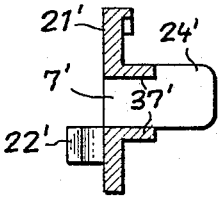
FIG. 6*b* is a cross-sectional view of the modified shield plate of FIG. 6*a;*
Figure 6A:
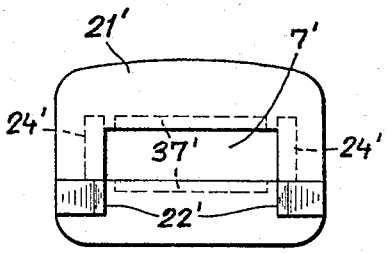
FIG. 6*a* is a front view of a shield plate similar to one shown as part of the assembly of FIGS. 1–3.
Figure 6C:
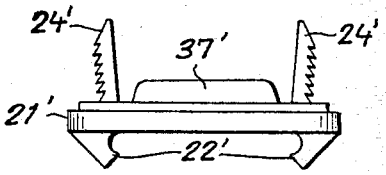
FIG. 6*c* is a top view of the shield plate of FIGS. 6*a* and 6*b.

In FIGS. 6*a*, 6*b* and 6*c* we have illustrated a modified shield plate 21' of substantially lesser height than plate 21 and without the rivet hole 32 of FIGS. 1 and 3. The plate 21' is otherwise substantially identical with plate 21, corresponding elements having been given the same reference numerals supplemented by a prime mark.

The various components of the disclosed assembly, aside from strap 5 and spring 9, could be made of metal or of suitable plastic material having the necessary elasticity for the interengagement of indexing formations 18 and 19, 22 and 23 or 24 and 25.

We claim:

1. In a suitcase having a wheel base and an end wall provided with a horizontal slit near an upper edge thereof, the combination therewith of a towing device comprising:

a housing extending vertically along an inner surface of said end wall with an opening facing said slit;

a contractile coil spring is said housing anchored to a lower end thereof;

s strap passing through said slit and said opening, said strap being coupled inside said housing to a free end of said spring at a location between said lower end and said slit; and a handgrip secured to an outer extremity of said strap, said handgrip being integral with a backing plate disposed behind said outer extremity and provided with at least one forwardly projecting pin, said outer extremity having a hole traversed by said pin, further comprising a front flap covering said outer extremity and engaging said backing plate to clamp said strap therebetween.

2. The combination defined in claim 1 wherein the free end of said spring is provided with deflecting means, said strap being looped around said deflecting means and having an inner extremity secured to an upper end of said housing.

3. The combination defined in claim 2 wherein said deflecting means includes a roller.

4. The combination defined in claim 1 wherein said front flap has an aperture aligned with said hole and traversed by the tip of said pin.

5. The combination defined in claim 1 wherein said front flap is an extension of said backing plate folded about said outer extremity.

6. The combination defined in claim 5 wherein said front flap and said backing plate are provided with coacting indexing formations.

7. The combination defined in claim 5 wherein said backing plate is provided with a pair of rearwardly facing lips separated by a gap and receivable in said slit in a retracted position of said strap, said outer extremity being bracketed by said lips.

8. The combination defined in claim 7 wherein said front flap is joined to said backing plate at a transverse edge thereof remote from said handgrip, said lips being disposed in the vicinity of said transverse edge.

9. The combination defined in claim 8, further comprising a shield plate on an outer surface of said end wall with an upper and a lower rib penetrating said slit, said lips being receivable between said ribs.

10. The combination defined in claim 9 wherein said housing has a web in line with said lower rib forming a lower boundary for said opening.

11. The combination defined in claim 9 wherein said housing and said shield plate are provided with interfitting coupling means.

12. The combination defined in claim 11 wherein said coupling means comprises serrated lugs penetrating said slit on opposite sides of said strap and complementarily serrated sidewalls of said housing.

13. The combination defined in claim 9 wherein said shield plate has lateral projections yieldably engaging said handgrip in said retracted position.

14. The combination defined in claim 2 wherein said housing has a rear wall with at least one pin projecting forward into contact with said end wall, said inner extremity having a hole traversed by said pin.

15. The combination defined in claim 2 wherein said housing is provided in the vicinity of said opening with lateral abutments positioned to prevent said deflecting means from reaching said slit.

16. In a suitcase having a wheel base and an end wall provided with a horizontal slit near an upper end thereof, the combination therewith of a towing device comprising:

a strap passing through said slit with a first extremity in the interior of said suitcase and a second extremity outside same;

spring means in the interior of said suitcase engaging said first extremity and exerting traction thereon tending to withdraw said strap into said suitcase;

a handgrip integral with a backing plate disposed between said second extremity and provided with at least one forwardly projecting pin, said outer extremity having a hole traversed by said pin; and a front flap covering said second extremity and engaging said backing plate to clamp said strap therebetween.

17. The combination defined in claim 16 wherein said backing plate is provided with a pair of rearwardly facing lips separated by a gap and receivable in said slit in a retracted position of said strap, said outer extremity being bracketed by said lips, said front flap being an extension of said backing plate joined thereto at a transverse edge thereof remote from said handgrip and folded about said second extremity.

18. The combination defined in claim 17, further comprising a shield plate on an outer surface of said end wall with an upper and a lower rib penetrating said slit, said lips being receivable between said ribs, said spring means being lodged in a housing engaged by said shield plate.

19. The combination defined in claim 18 wherein said shield plate has a pair of lugs flanking said strap and projecting inward through said slit, said housing having sidewalls engaged by said lugs.

* * * * *